United States Patent [19]

Kreager

[11] Patent Number: 4,517,787

[45] Date of Patent: May 21, 1985

[54] METHOD AND APPARATUS FOR SEALING BAGS

[75] Inventor: William D. Kreager, Dallas, Tex.

[73] Assignee: Frito-Lay, Inc., Dallas, Tex.

[21] Appl. No.: 408,918

[22] Filed: Aug. 17, 1982

[51] Int. Cl.[3] ..... B65B 51/26; B65B 9/10; B65B 9/12

[52] U.S. Cl. ..... 53/450; 53/451; 53/550; 53/551; 53/383; 118/411; 156/578

[58] Field of Search ..... 53/550, 551, 552, 554, 53/555, 383, 450, 451; 156/578; 493/302, 266; 118/411, 412

[56] References Cited

U.S. PATENT DOCUMENTS

| | | | |
|---|---|---|---|
| 510,110 | 0/1893 | Berkan | 118/412 |
| 896,504 | 8/1908 | Adams | 118/412 |
| 2,914,108 | 11/1959 | Coakley | 118/411 |
| 2,916,012 | 12/1959 | Hergenrother | 118/412 X |
| 3,032,008 | 5/1962 | Land et al. | 118/411 |
| 3,078,824 | 2/1963 | Bechle | 53/383 X |
| 3,918,235 | 11/1975 | Brown, Jr. et al. | 53/551 X |
| 3,938,467 | 2/1976 | Radowicz | 156/578 X |
| 4,038,442 | 7/1977 | Utumi | 118/412 X |
| 4,143,187 | 3/1979 | Pilgrim et al. | 118/411 X |

*Primary Examiner*—Horace M. Culver

*Attorney, Agent, or Firm*—Bernard, Rothwell & Brown

[57] ABSTRACT

A method and apparatus for forming and sealing bags in a continuous or intermittent manner where the bags can be filled during the forming operation. Specifically, there is disclosed an apparatus for supplying a sheet or film of bag material to a mechanism for forming the sheet into a tube having overlapping edges in a longitudinal direction. A series of plates are arranged in the forming apparatus for applying adhesive in spaced lines or strips on opposed surfaces of the overlapping edges. After the adhesive is applied in this manner the opposed surfaces of the overlapped edges are pressed together to seal the edges. The tube is sealed in a transverse direction at the bottom, filled in a conventional manner, sealed in a transverse direction at the top, and then cut to form the bag filled with food or other material, ready for distribution and sale.

15 Claims, 14 Drawing Figures

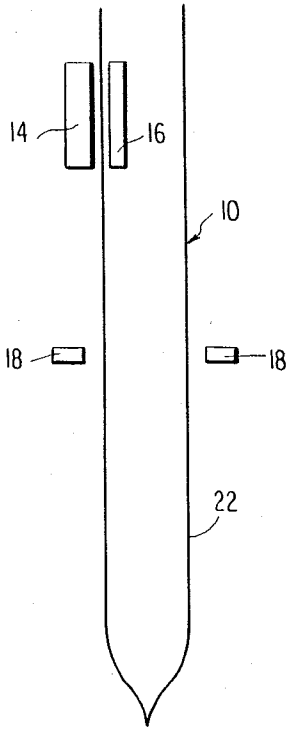
FIG. 1 (a)
PRIOR ART
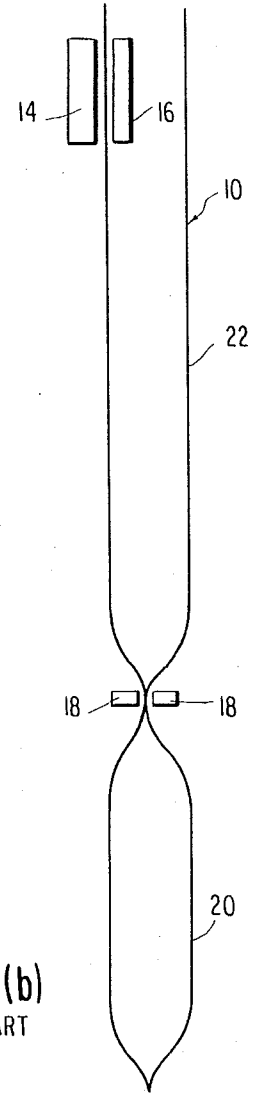
FIG. 1 (b)
PRIOR ART
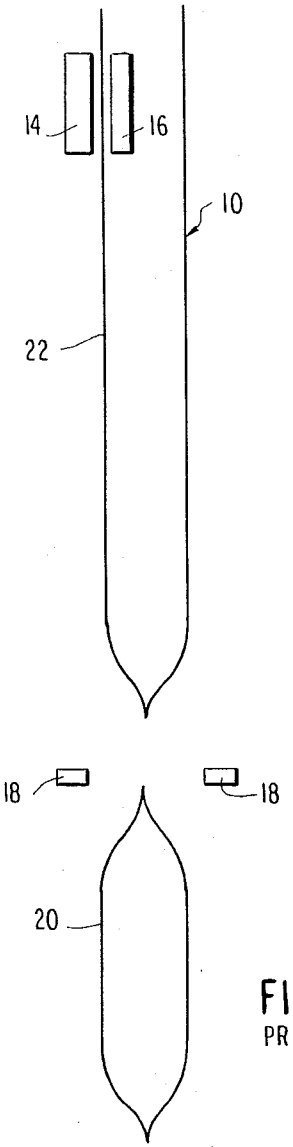
FIG. 1 (c)
PRIOR ART
FIG. 1 (d)
PRIOR ART

METHOD AND APPARATUS FOR SEALING BAGS

BACKGROUND OF THE INVENTION

1. Field of The Invention

This invention relates to a method and apparatus for forming and sealing bags employed for packaging food or other material and, more particularly, to improved method and apparatus for applying an adhesive material to edges to be sealed.

2. Description of The Prior Art

In a typical vertical form and fill bag-making operation for packaging potato chips and similar snacks, apparatus is frequently employed in which film material in sheet or web form is supplied with a continuous or intermittent motion to a forming apparatus which forms the web into a tubular shape with either overlapping or fin-type edges. Glue or other adhesive is often pre-applied to one or more edges of the film. The film, after being formed into the tubular shape, is passed through a sealing apparatus in which heat and pressure are applied to seal the edges together. In overlapping edges the adhesive is applied to edges on opposite faces of the web; in fin-type seals the adhesive is applied to edges on the same face of the web.

In one form of such apparatus, a transverse seal is made to close the top of one bag and form the bottom of the succeeding bag. A downward pull is applied to the transversely sealed area and the overlapping edges of the tubular film are drawn along a device to heat-seal the longitudinal edges of the bag. The bag is filled and a transverse seal is formed at the top of the bag. The formed bag is severed, and the process is then repeated by the apparatus.

The film material employed should be one which adequately protects the food material or other product being packaged, is pleasing in appearance, is strong enough to withstand shipping and handling environments, and is amenable to forming and sealing, among other characteristics. The film material often used in the apparatus for forming bags may include a laminate having for example as one component a layer of polyvinylidene chloride class (e.g., that material sold commercially under the trademark "Saran") and as the other component a layer of uncoated polypropylene. For a lap seal, i.e., where one edge of the sheet material overlaps the other, this results in a "Saran" surface facing the uncoated polypropylene surface in the area of the overlap. These materials are not compatible for heat sealing to one another. Consequently, where heat sealing is involved, it is necessary to employ a separate material secured to one or more of the overlapping edges to insure that the surfaces facing one another for bonding have similar or compatible characteristics.

Where a thermal, or heat, seal is desired using dissimilar materials a separate strip of thermal seal material is bonded along one edge of the web by the manufacturer of the film to assure thermal bonding compatibility. This separate strip is oriented in the machine direction along the edge of the web so that as the forming apparatus creates the tube the strip applied, for example, to outer face of the polypropylene will provide a more compatible material with respect to thermal bonding capability facing the "Saran" layer side of the web in the vicinity of the overlap. This facilitates forming a thermal seal when the edges are pressed together and heated.

In addition to the time and expense required in applying this separate strip, the thickness of the strip causes a number of other problems in handling and forming of the sheet material into filled bags. Buckling can occur in the vicinity of the web material where the strip has been applied, causing the material to pucker when sealed. When the web material is rolled, one end of the roll, where the strip is applied, tends to be thicker than the other, causing the web to stretch. As a result uniformity and reliability in forming and sealing the bags is lost or at least substantially impaired. There is also a problem with air bubbles getting into adhesive seals.

SUMMARY OF THE INVENTION

The present invention overcomes these problems and avoids the use of a thermal strip while maintaining an effective seal between the engaging portions of the sheet material. This is accomplished by applying an adhesive in thin lines or strips longitudinally along the facing surfaces of the overlapping or fin type edges. The lines of adhesive are spaced from one another to form a gap between adjacent lines. The adhesive is applied in such a manner as to provide lines or strips of adhesive on one face of the material opposite complementary gaps or spaces formed between the lines of adhesive on the other face of the overlapping edges of the web material. When the materials are pressed together the adhesive on one face will fill in the gaps in the opposed face and flow together to form a firm continuous seal between the overlapped material. With the method and apparatus of this invention the desired seal is achieved without the need of an additional thermal strip or other special treating steps for the incompatible surface materials. Also this method eliminates air bubbles in the seals.

The apparatus employed in this method, in one form thereof, includes a series of plates arranged in stacked relationship and configured for receiving adhesive from a source and delivering the adhesive to the overlapping, opposed, facing surfaces of the web material as it moves past the plates during the forming and filling operation. Preferably, each of the plates has a coating cavity extending entirely through the plate for communication with the corresponding cavity in adjacent plates. A dispensing path communicates the coating cavity to one side or surface of the plate exposed to an overlapping portion of the web material. A series of plates are arranged in stacked relationship and in a regular alternating pattern such that the dispensing paths for adjacent plates extend in opposite directions to form the lines of adhesive on the overlapping edges of the web material alternating with gaps between the lines corresponding to the width of one plate. After adhesive is delivered to the overlapping edges of the web material, the edges are pressed together by a mechanical means to form the longitudinal seal. To close the bag transverse to the longitudinal seal the ends of the bag are formed by heat sealing across the entire width of the tube to form the top and bottom ends of the bags.

BRIEF DESCRIPTION OF THE DRAWINGS

FIGS. 1*a*–1*d* are schematic representations of the steps in forming and sealing film material utilizing conventional apparatus.

DETAILED DESCRIPTION OF THE PREFERRED EMBODIMENT

Figure 2:
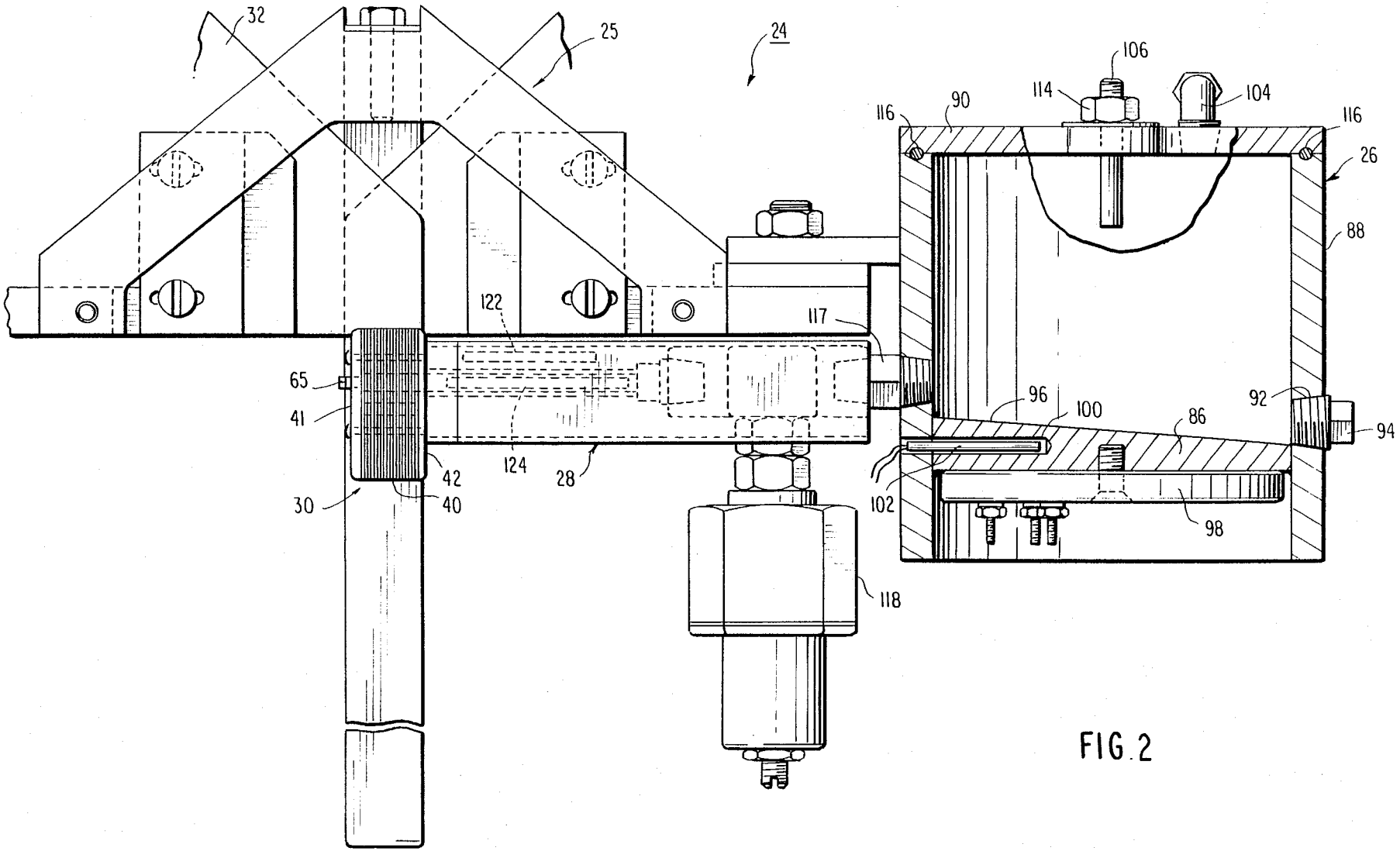
FIG. 2 is a front elevation view, partially in section, of the apparatus of this invention including a series of plates for delivering adhesive to the overlapping edges of a web of film material formed in the tube-forming apparatus.

For a better understanding of the invention and the problems which it solves, it will be helpful to refer first to FIGS. 1(*a*)–1(*d*) which illustrate schematically the formation of film packages of the type here involved utilizing prior art apparatus. Sealable sheet or web material, for example, plastic film, is supplied from a roll and passed over a former (not shown) which places the film in the tubular shape illustrated at 10. In the form illustrated, the edges, generally indicated at 12 in FIG. 1(*a*), are in overlapping relationship. These edges are positioned between a back seal bar 14 and a back seal tongue 16. The back seal bar is pressed toward the tongue by a spring or by magnetic or hydraulic means (not shown because well known in the art) to hold the overlapping edges in good sealing relationship. Heat is supplied to the back seal bar 14 to effect the sealing operation.

Heated dies 18 placed below the back seal bar and back seal tongue are provided for effecting a transverse seal under heat and pressure. The heated dies are brought into engagement with the film material to form the transverse seal. This transverse seal simultaneously forms the sealed top of one bag 20 and the sealed bottom of the successive bag 22. The dies 18, while engaging the film material, are moved downwardly to the position shown in FIG. 1(*b*), causing the overlapping edges to be moved longitudinally through the space between the back seal bar 14 and the back seal tongue 16 to effect a seal therebetween. The product to be contained in the completed bag is supplied through the tube of film material during this time to fill the bag.

The completed bag 20 is severed as shown in FIG. 1(*c*) and the dies 18 are separated and moved upwardly to the position shown in FIG. 1(*d*). The dies are then brought together to effect another transverse seal forming the completed bag 22, and the process shown in FIGS. 1(*a*)–1(*d*) is repeated.

Figure 3:
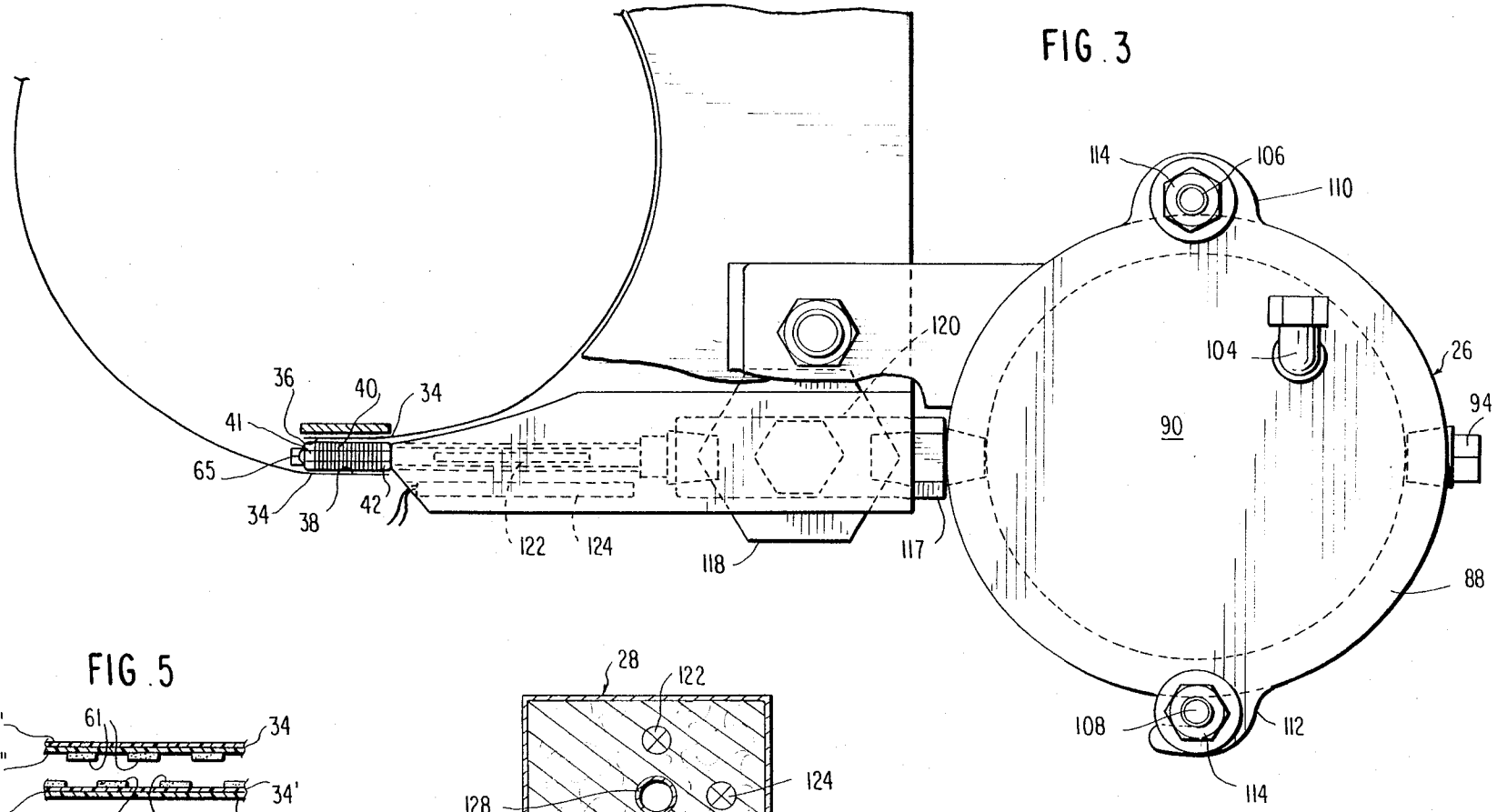
FIG. 3 is a top plan view of the apparatus illustrated in FIG. 2 showing the web with the series of plates arranged for delivering the spaced strips or lines of adhesive to the overlapping edges.

Referring now to FIGS. 2 and 3, there is shown a bag forming and sealing apparatus 24 constructed in accordance with this invention and including forming apparatus 25, a tank or pot 26 which contains fluid adhesive melt and a transfer line 28 which connects an applicator 30 to the tank 26. Applicator 30 delivers the adhesive to sheet or web 32 as it is passed through the forming apparatus 25 with overlapping edges 34 on opposite sides of the applicator, as can be seen more clearly in FIG. 3. While this invention is illustrated in connection with bags which are formed from material in which the edges are overlapping, it is equally applicable to bag-making operations in which fin-type edges are utilized. The term "overlapping" employed in the description and claims is intended, therefore, to include both overlapping and fin-type edges.

As the forming apparatus 25 itself is conventional in construction and operation, details of forming the sheet material into a tube with the overlapping edges, as shown, will not be discussed. For the purposes of the invention described herein it is only necessary to know that a conventional forming apparatus can be employed which can take a sheet or web and form it into a tube to achieve the overlapping edges, as shown best in the plan view of FIG. 3.

The applicator 30 is located at a dispensing station in the forming apparatus to apply adhesive to the outer surface of one portion of the overlap and to the inner surface of other portion of the overlap. The overlapping edges 34 will be described in terms of the inside edge 36 corresponding to the outer surface of the one portion and the outside edge 38 corresponding to the inner surface of the other portion. The applicator 30 includes a plurality of intermediate applicator plates 40 arranged in abutting relationship and sandwiched between a left end plate 41 on one side and by a right end plate 42 on the other side.

The end plates 41 and 42 and one of the plurality of intermediate plates 40 are shown in detail in FIGS. 4(*a*)–4(*e*). The plurality of plates 40 are arranged in contiguous relationship between the end plates 41 and 42. Each plate 40 is formed with a central cavity 43, the aligned cavities 43 of the plurality of intermediate plates 40 forming a continuous cavity extending the width of the applicator 30 for receiving adhesive from a suitable source, which in the form of the invention illustrated is the tank 26. While only one intermediate plate 40 is illustrated in FIGS. 4(*b*) and 4(*c*) it will be understood that all plates 40 are similarly formed, the only difference between the plates 40 being, as discussed in more detail later, that successive plates have their dispensing paths directed to opposite sides of the applicator 30.

Each plate 40 includes a dispensing path 44 which communicates coating cavity 43 to an exposed surface of the plate. A first set of alternate plates dispenses to one side of the applicator, while a second set of alternate plates, intermediate the plates of the first set, dispenses to the other side. Each of plates 40 generally has somewhat of an air foil configuration and is defined by four surfaces. The largest area dimension of each plate is formed by planar sides 46 and 48 parallel to one another. These sides form the surfaces which are contiguous to adjacent plates. The coating cavity 43 is a cylindrical hole drilled entirely through the planar surfaces at the same location for each plate 40 such that when the plates 40 are arranged in abutting relationship the coating cavities 43 register with each other to form a continuous, cylindrical passage through the series of plates 40.

Cavity 43 is located generally in the center of the planar surface or slightly above the center. Located above and below, on either side of cavity 43 are holes 50 and 52, respectively, drilled entirely through each plate 40 for receiving bolts or other fastening means to secure plates 40 together between the end plates.

Figure 5:
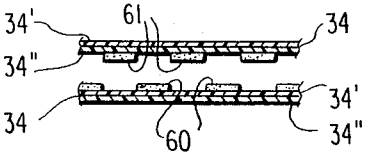
FIG. 5 is a sectional view, in exaggerated form, of the overlapping edges of the web after the adhesive has been applied and immediately before the edges are brought into sealing relationship.
Figure 4E:
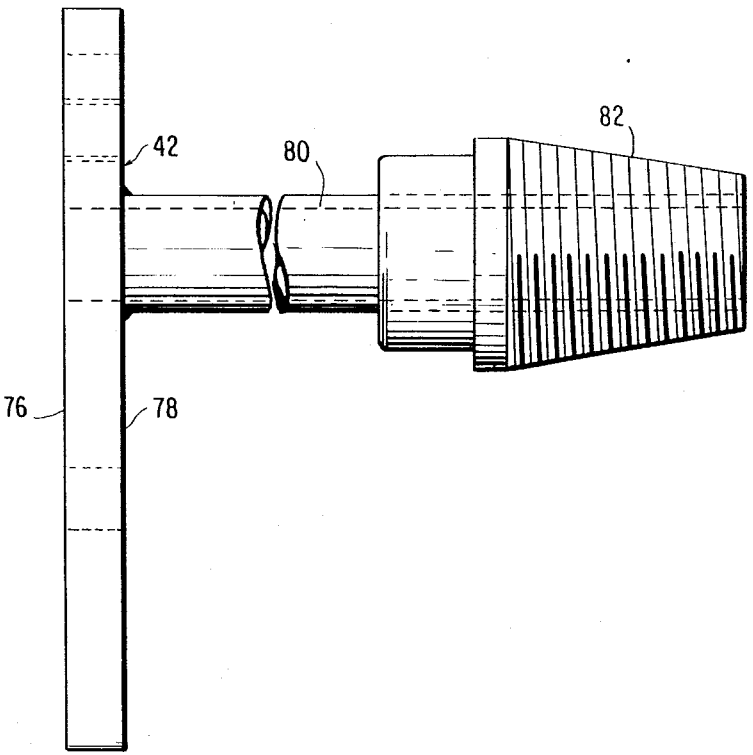
FIGS. 4(*a*), 4(*b*), 4(*c*), 4(*d*) and 4(*e*) are enlarged views, showing plates employed in the adhesive applicator shown in FIGS. 2 and 3.
Figure 4D:
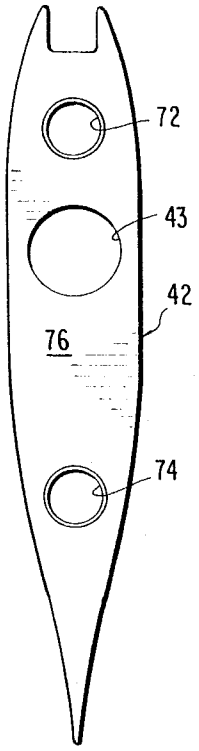
Figure 4C:
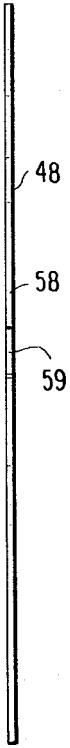
Figure 4B:
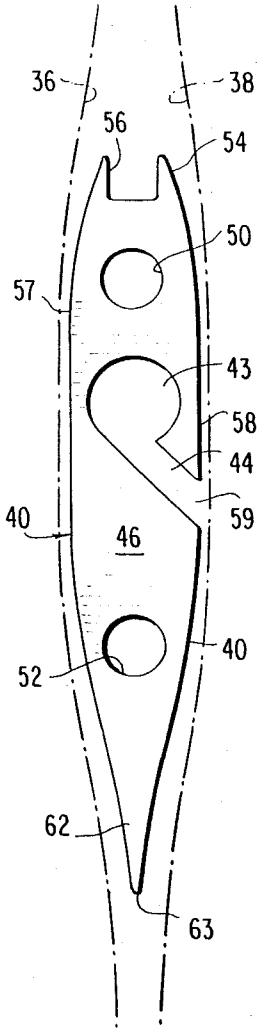
Figure 4A:
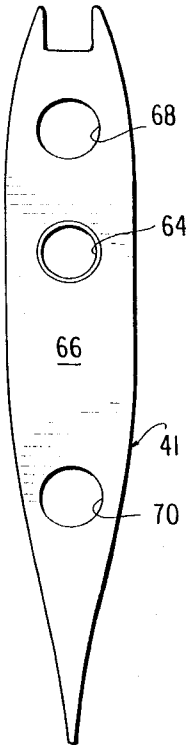
Figure 7:
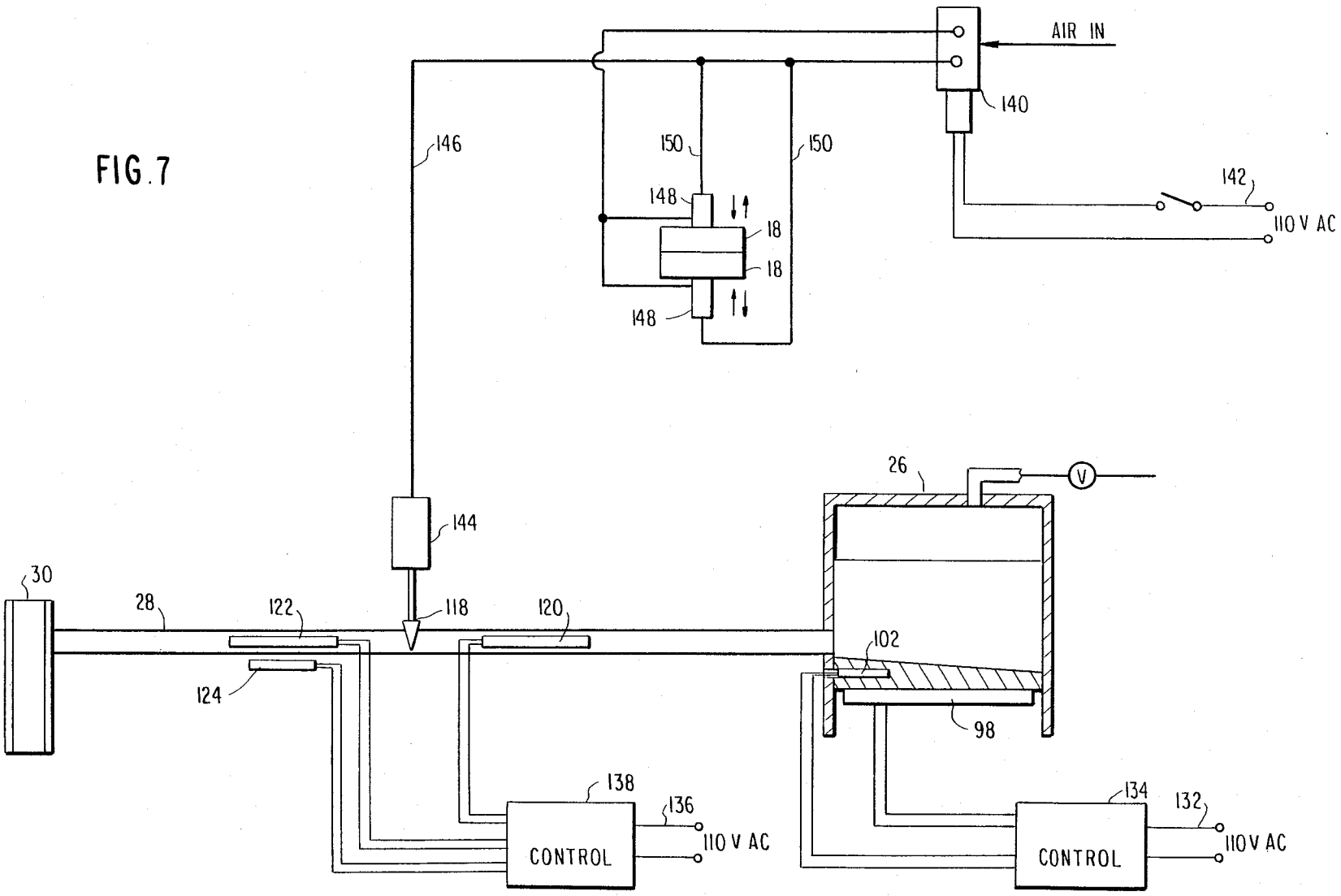
FIG. 7 is a schematic diagram showing elements of the apparatus including electrical circuits associated therewith.

The upper portion or head 54 of each plate 40, as shown in FIG. 4(*b*) includes a slot 56 transverse to the planar surfaces. When plates 40 are arranged in series, slots 56 in the plates 40 are in registry to form a continuous slot having a length equal to the combined width of the stacked plates. This slot provides a means for orienting the plates in the proper disposition and connecting the applicator 30 formed by the series of plates 40 to the forming apparatus such that the plates 40 lie between inside edge 36 and outside edge 38 of sheet or web 32. Each plate 40 includes edge surfaces 57, 58. In the form of plate 40 shown in FIGS. 4(*b*) and 4(*c*) the dispensing path 44 extends to an opening 59 in the edge 58 and adhesive is supplied through opening 59 to one side of applicator for coating one of the overlapping edges of the film material. Alternate plates 40 forming one set are made in the form shown in FIGS. 4(*b*) and 4(*c*) to dispense adhesive in spaced strips or lines along one of the aforementioned overlapping edges. A second set of alternate plates, assembled between the plates of the first set, are each made as a mirror image of the plate 40 shown in FIGS. 4(*b*) and 4(*c*). In other words, the plates of this second set are identical with that shown in FIGS. 4(*b*) and 4(*c*) except that the dispensing path 44 extends to the opposite edge, that is, extends to the left to the edge 57 rather than to the right to the edge 58. Thus, the plates of this second set dispense adhesive in spaced strips or lines on the opposite side of the applicator 30 to coat the other of the overlapping edges of film material. Since the alternate plates of one set of plates 40 are intermediate the alternate plates of the other set of plates 40, the spaced lines of adhesive supplied from one set of plates to one overlapping edge will be aligned with the spaces between lines of adhesive supplied to the other overlapping edge. Thus when the edges are pressed together, the lines of adhesive form a continuous coated surface, as best shown in exaggerated form in FIG. 5. As there shown, the overlapping edges of the laminated web each include a portion 34' of one material and a portion 34" of a different material which may be incompatible with the first material for heat sealing purposes. As shown in FIG. 5, in an overlapping seal these incompatible surfaces face each other and must be sealed to each other. In accordance with this invention, the applicator 30 supplies adhesive from one side thereof to one overlapping edge in a plurality of spaced lines or strips 60 and supplies adhesive from the opposite side thereof in a plurality of spaced strips or lines 61 which are aligned with the spaces between the lines 60. When the edges are brought together, as described below, the adhesive forms a continuous coating and a continuous, effective seal.

Adhesive is delivered through openings 59 to edges 36 and 38 of the film material as these overlapping edges are passed through the apparatus. The surfaces 57, 58 form opposed continuous curvilinear surfaces extending transversely of the planar surfaces 46, 48. These surfaces 57, 58 converge at one end to form a tail 62 terminating at tip 63 and at the other end provide sufficient width at the head 54 to include the slot 56 approximately $\frac{1}{8}$ inch wide. The width of surfaces 57, 58 is much smaller than that of the planar surfaces 46, 48; in a specific embodiment this width is about 0.020 inch.

The relative position of the plates 40 and the overlapping edges 36, 38 of the film material is shown in FIGS. 3 and 4(*b*). The plates 40 are assembled so that exposed edges 57 and 58 face and are engaged by the inside edge 36 and outside edge 38, respectively. The adhesive is supplied through the cavity 43 along dispensing paths 44 and through openings 59. The overlapping edges, after the application of adhesive, are drawn together along a path defined by tails 62. The upper portions of surfaces 57, 58 are convex from the head 54 to a location beyond the midpoint of the plates and from this location these surfaces are slightly concave to tip 63. The length of each plate 40 is about $1\frac{1}{4}$ inches and the width at the widest portion of the planar surfaces is about $\frac{1}{4}$ inch. This configuration controls the separation and mating of overlapping edges 34 during adhesive application and bonding.

The dispensing paths 44 extend angularly downward from cavity 43 to the dispensing openings 59. By locating the paths and openings in this manner withdrawal of the fluid adhesive as the overlapping edges 34 of the web of film material are moved past the dispensing openings 59 is enhanced by gravity feed and a slight aspirating effect of the downward moving web. If the openings were located at a position above the center line of cavity 43 additional force or pressure would be required to insure that the adhesive is applied properly, since movement of the web of film material would then tend to force the adhesive back into dispensing paths rather than drawing it downwardly out of the paths, as achieved by the configuration described herein.

End plates 41 and 42, in addition to supporting the intermediate applicator plates 40 in place, provide additional operative features to the applicator 30. These features include a means for connecting the coating cavity to the adhesive source and a means for permitting purging of the system. The end plates have a configuration similar to that of plates 40, but are substantially thicker, having a width in one specific embodiment of about $\frac{1}{8}$ inch.

Left end plate 41, shown in FIG. 4(*a*), is substantially identical to the intermediate plates 40 except for the absence of a dispensing path 44 and dispensing opening 59. Plate 41 includes a tapped hole 64, which registers with cavity 43, for accepting a plug 65 (see FIGS. 2 and 3) to close the hole 64 during the operation of the applicator. Left end plate 41 further includes planar surface 66 for abutting a complementary planar surface on the adjacent intermediate plate 40. Upper and lower bolt holes 68 and 70, which register with holes 50 and 52, respectively, of the plates 40, are located above and below the tapped hole 64 for receiving the bolts in the same manner as intermediate plates 40.

Right end plate 42, shown in FIGS. 4(*d*) and 4(*e*), includes cavity 43 but no dispensing path nor dispensing opening. Upper and lower threaded holes 72 and 74 above and below the cavity 43 register with the bolt holes 50 and 52, respectively, in the plates 40 to receive bolts for securing the end plates and intermediate plates in assembled position. The right end plate 42 further includes a planar surface 76 for abutting the complementary planar surface on an adjacent intermediate plate 40, and an outside planar surface 78 to which is attached tubing 80 for transferring the adhesive from transfer line 28 to the cavity 43 of the plates 40. Tubing 80 at one end is fixed to end plate 42 in communication with the cavity 43 and at the other end includes a fitting 82 for securing the tubing to transfer line 28.

During assembly bolts are fitted through the holes in left end plate 41 and intermediate plates 40 and threaded into holes 72 and 74 of right end plate 42 to hold the plates tightly together in assembled relationship. The plug for tapped hole 64 remains in place during operation of the applicator. When it is desired to purge the cavity 43, the plug is removed to allow adhesive in the cavity to be purged quickly through hole 64. Once the system has been satisfactorily purged, the plug is replaced to place the system in an operative mode for applying adhesive.

As shown in FIG. 2, the tank 26 for supplying the adhesive to applicator 30 includes a bottom 86, a cylindrical side wall 88, and a removable top or cover 90. A drain hole 92 with removable plug 94 is located adjacent bottom 86 to permit drainage of tank 26 when not in use. Bottom 86 includes a slanted surface 96 sloping toward the drain hole 92 which is located in communication with this surface. This insures that during drainage all of the adhesive within tank 26 will flow toward drain hole 92 and minimize residual adhesive remaining in the tank. While a variety of adhesives may be employed, in one specific form of this invention it is contemplated that a hot melt adhesive will be employed. To maintain such an adhesive at the proper temperature a heater 98 is located beneath tank 26 to heat the adhesive material within the tank. A cavity 100 is provided in bottom 86 for receiving a thermistor 102 or other temperature control device employed with a control system to control the temperature of the adhesive.

The preferred adhesive material employed is heated to a temperature between 250° F. and to 350° F. The upper limit of this temperature range is a temperature which does not cause distortion of the sheet material to which the adhesive is being applied. Thus, if foil is employed as opposed to, for example, plastic film material, such as polypropylene, polyethylene, etc., the temperature may be higher. The adhesive should be such as to maintain the seal between the overlapping edges of the bag when the bag is subjected to a high temperature of about 160° F. without becoming plastic and when subjected to a temperature below 0° F. without "plating out" or becoming unduly brittle, both of which conditions can cause the seal to break. These temperature limits are those which can occur during delivery and storage of the food product contained in the bag.

As indicated above, while a hot melt adhesive is employed in the specific embodiment disclosed, other adhesives, including adhesives which need not be heated in the tank and transfer line may be employed. The adhesive used should include a combination of materials for achieving the proper adhesiveness and fluidity. It may include, for example, wax, rosin, a tackifier and sealants.

In the system described, the adhesive in the tank 26 is maintained under pressure provided by nitrogen gas which may be supplied, for example, from any standard bottled source. Nitrogen is employed because it inhibits degradation of the adhesive, which degradation could occur if air or oxygen were employed. Air or oxygen could cause some oxidation of the adhesive, which could result in the hardening and darkening of the material. This could cause both a poor appearance of the seal and also could cause the seal to fail. Further, the avoidance of oxidation is desirable in order to insure that the proper viscosity of adhesive is maintained as the adhesive is supplied from the tank 26 through the applicator 30 to the overlapping edges 34.

Extending upwardly from the cover 90 is an adapter 104 for communicating the tank to a source of gas, such as a nitrogen, under pressure. As can be seen in FIGS. 2 and 3, two studs 106 and 108 are secured to the tank 26 on diametrically opposite sides thereof and extend above cover 90 to provide a means for securing the cover in place. The cover 90 includes a flange 110 having a hole therethrough for receiving stud 106. A hook 112 is formed on the cover 90 to engage stud 108. Nuts 114 are provided for engaging the studs 106 and 108 to secure cover 90 in sealing engagement with the tank once the cover is properly in position.

Complementary annular recesses are provided in the top of wall 88 and in the cover 90 to receive a sealing member, such as an O-ring 116. When it becomes necessary to refill the tank the nuts 114 are loosened and the cover is swung out of place, pivoting around stud 106. When a sufficient amount of adhesive has been placed within the tank 26, cover 90 is then swung back into a closed position where the hook 112 engages stud 108. The nuts 114 are then tightened to secure the cover in place.

Figure 6:
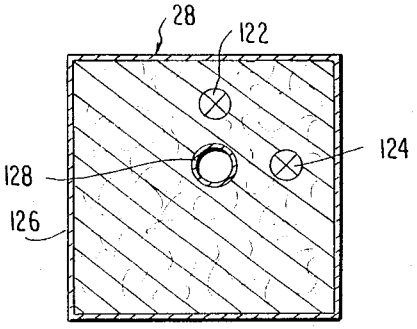
FIG. 6 is a sectional view of a portion of a transfer line, showing components included therein.

Tank 26 is also provided with a connector 117 for placing the tank in communication with the transfer line 28. Between the connector 117 and the transfer line 28 there is provided a valve 118 which is pneumatically actuated under controlled conditions to control the delivery of adhesive to the applicator 30 as a function of the operation of the forming and bagging mechanism. Since the valve may be a standard needle valve, the details of the valve will not be described herein. In order to maintain the adhesive at the proper temperature during transfer from the tank 26 to the applicator 30 one or more heaters are provided. In the specific apparatus shown in FIG. 3 two heaters 120 and 122 are provided. The first heater 120 is disposed in the area of the valve 118 and the second heater 122 is disposed in the transfer line 28 downstream of the valve 118. Where a longer section of transfer line is included between the tank 26 and the valve 118, the first heater 120 may be disposed in that section of the transfer line, as shown in FIG. 6. In order to control the temperature of the adhesive passing through the transfer line 28 and assure proper viscosity at the applicator 30, a heat probe 124 in the form of a thermistor or other temperature-sensing device is provided in the transfer line.

As shown in FIG. 5, the transfer line 28 includes a surrounding metal case 126 within which are disposed a conduit 128 through which the adhesive is conveyed from the tank 26 to the applicator 30, the heater 122 and the heat probe or thermistor 124. Within the casing 126 and surrounding the heater 122, the heat probe 124, and the conduit 128 is a heat transfer bedding 130. The bedding 130 may be any suitable heat-conducting material for insuring transfer of heat between the heater 122 and the conduit 128 and between the conduit 128 and the probe 124.

The control system for the apparatus is shown schematically in FIG. 6. FIG. 6 illustrates some of the apparatus elements previously described, including the adhesive supply tank 26 and the transfer line 28 through which adhesive is conveyed from the tank 26 to the applicator 30. The valve 118 disposed in the transfer line 28 for controlling flow of adhesive to the applicator is also shown in FIG. 6. The heater 98 in the tank 26 and heaters 120 and 122 in the transfer line 28 are shown, along with the temperature-sensing heat probes 102 in the tank and 124 in the transfer line. The heater 98 in the tank 26 is supplied with electrical energy from a standard 110-volt source 132 through a conventional control 134, which may be, for example, a commercially available Fenwal control. The thermistor 102 is connected to the control 134 for effecting energization and deenergization of the heater 98. Since the particular control 134 may be any conventional control suitable for the purpose, is commercially available, and is not part of the applicant's invention, it is not being described in detail. Similarly, the heaters 120 and 122 in the transfer line 28 are supplied with electrical energy from a standard 110-volt supply 136 through a similar conventional control 138, and the thermistor 124 is connected to the control 138 for effecting energization and deenergization of these heaters.

The valve 118 is pneumatically controlled and is coordinated with the movement of the transverse sealing jaws 18 so that adhesive is supplied to the applicator 30 and thereby to the overlapping edges of the sheet material or web only when the sheet material is being drawn past the applicator. As shown in FIG. 6, air under pressure is supplied to actuate the valve 118 and the jaws 18 under control of a solenoid 140 which is supplied from a standard 110-volt source 142. As previously described in connection with FIGS. 1(*a*)–1(*d*), the jaws 18 are closed to effect transverse sealing and, while closed, are moved downwardly from the position shown in FIG. 1(*a*) to that shown in FIG. 1(*b*). During this time, the web of film material in tubular form is moved downwardly past the applicator 30. Accordingly, when the jaws 18 are closed, and are being moved downwardly from the position shown in FIG. 1(*a*) to the position shown in FIG. 1(*b*), it is desired that adhesive be supplied in spaced lines or strips to the overlapping edges 34 of the web. In accordance with this invention, the movement of the jaws 18 and the opening and closing of the valve 118 are coordinated so that when the jaws 18 are closed the valve 118 is open to supply adhesive to the applicator 30. The valve 118 is constructed so as to move to its open position when air is supplied to the control member 144; when the supply of air is cut off by the solenoid 140 the valve 118 is returned to its closed position by a spring. At the same time that air is supplied through the line 146 to open valve 118, air under control of the solenoid 140 is provided to control elements 148 through lines 150 to effect closing of the jaws 118. When the supply of air is cut off by the solenoid 140 in the operation of the bagging and forming machine, the jaws 18 are moved to their open position by a spring or other return means and simultaneously the valve 118 is moved to its closed position by the spring return incorporated in the control of that valve. By the above arrangement, it can be seen that when the jaws 18 are closed and the sheet material is being moved past the applicator 30, the valve 118 is open to insure a supply of adhesive to the applicator and to the overlapping edges 34. Conversely, when the jaws 18 are in the open position, as shown in FIGS. 1(*c*) and 1(*d*), and the sheet material or web is therefore stationary, the valve 118 is closed to cut off the supply of adhesive to the applicator 30.

After the adhesive is applied to the overlapping edges, these edges are passed between the conventional back seal bar 14 and back seal tongue 16, where heat and pressure are applied in a conventional manner to effect sealing of these edges.

While a specific embodiment of this invention has been shown and described, it will be understood that modifications within the scope of the appended claims will occur to those skilled in the art. It is intended, therefore, to cover all such modifications which come within the spirit and scope of the claims.

It is claimed:

1. In an apparatus for forming and sealing bags made of sealable sheet material of the type including a bag-forming unit; means for supplying sheet material to said forming unit; said forming unit including means for shaping said sheet material into tubular form with overlapping edges; the improvements comprising:

(a) an applicator for applying adhesive to opposed facing surfaces of said overlapping edges, said applicator means including a plurality of plates arranged in abutting relationship between said overlapping edges, said plurality of plates including a first set of alternate plates configured to dispense adhesive to one of said opposed surfaces to form spaced lines of adhesive with gaps therebetween and a second set of alternate plates alternating with the plates of said first set configured to dispense adhesive to the other of said opposed surfaces to provide spaced lines of adhesive facing the gaps between spaced lines of adhesive on said one of said opposed surfaces; and (b) means for moving said overlapping edges past said applicator for applying adhesive to said opposed facing surfaces.

2. The apparatus according to claim 1 wherein said plates have exposed surfaces and abutting surfaces, each of said plates defining a cavity extending through abutting surfaces and communicating with a corresponding cavity in adjacent plates to form a continuous path therethrough.

3. The apparatus according to claim 2 wherein each of said plates includes a dispensing path communicating with said cavity and an opening in one exposed surface for supplying adhesive from said cavity to a corresponding one of said overlapping edges.

4. The apparatus according to claim 3 wherein each of said plates includes a head portion defining a slot, and means receivable in said slots for aligning the plates in the proper relationship.

5. The apparatus according to claim 3 wherein said dispensing path extends downwardly from said cavity, for facilitating the dispensing of adhesive as the overlapping edges are moved downwardly past the dispensing opening.

6. The apparatus according to claim 2 and further including valve means for controlling flow of adhesive to said applicator wherein during a bag-forming operation said valve means is actuatable between a closed position to stop adhesive flow when said overlapping edges are not being moved past said applicator means and an open position to permit adhesive flow when said overlapping edges are being moved past said applicator.

7. In an apparatus for forming and sealing bags made of sealable sheet material of the type including a bag-forming unit; means for supplying sheet material to said forming unit; said forming unit including means for shaping said sheet material into tubular form with overlapping edges; the improvements comprising:

(a) an applicator for applying adhesive to opposed facing surfaces of said overlapping edges, said applicator means including a plurality of plates arranged in abutting relationship between said overlapping edges, said plates including a first set of alternate plates configured to dispense adhesive to one of said opposed surfaces to form spaced lines of adhesive with gaps therebetween and a second set of alternate plates alternating with the plates of said first set configured to dispense adhesive to the other of said opposed surfaces to provide spaced lines of adhesive on said other of said opposed surfaces; and (b) means for moving said overlapping edges past said applicator for applying adhesive to said opposed facing surfaces;

(c) said plates having exposed surfaces and abutting surfaces, each of said plates defining a cavity extending through abutting surfaces and communicating with a corresponding cavity in adjacent plates to form a continuous path therethrough;

(d) each of said plates including a dispensing path communicating with said cavity and an opening in one exposed surface for supplying adhesive from said cavity to a corresponding one of said overlapping edges;

(e) said exposed surfaces of each of said plates converging to form a tail portion for allowing said overlapping edges of the sheet material to move toward abutting relationship to facilitate sealing after adhesive has been applied thereto.

8. In an apparatus for forming and sealing bags made of sealable sheet material of the type including a bag-forming unit; means for supplying sheet material to said forming unit; said forming unit including means for shaping said sheet material into tubular form with overlapping edges; the improvement comprising:

(a) an applicator for applying adhesive to opposed facing surfaces of said overlapping edges, said applicator means including a plurality of plates arranged in abutting relationship between said overlapping edges, said plurality of plates including a first set of alternate plates configured to dispense adhesive to one of said opposed surfaces to form spaced lines of adhesive with gaps therebetween and a second set of alternate plates alternating with the plates of said first set configured to dispense adhesive to the other of said opposed surfaces to provide spaced lines of adhesive facing the gaps between spaced lines of adhesive on said one of said opposed surfaces;

(b) means for moving said overlapping edges past said applicator for applying adhesive to said opposed facing surfaces;

(c) said plates having exposed surfaces and abutting surfaces, each of said plates defining a cavity extending through abutting surfaces and communicating with a corresponding cavity in adjacent plates to form a continuous path therethrough; and (d) valve means for controlling flow of adhesive to said applicator;

(e) said apparatus including sealing jaws for forming transverse seal, said jaws being movable between a closed position and an open position, said jaws effecting movement of said overlapping edges past said applicator when in their closed position, pneumatic means connected to said jaws and said valve means for controlling opening and closing thereof, said pneumatic means being controlled to open said valve means for supplying adhesive to said overlapping edges when said pneumatic means moves said jaws to their closed position.

9. In an apparatus for forming and sealing bags made of sealable sheet material of the type including a bag-forming unit; means for supplying sheet material to said forming unit; said forming unit including means for shaping said sheet material into tubular form with overlapping edges; the improvement comprising:

(a) an applicator for applying adhesive to opposed facing surfaces of said overlapping edges, said applicator means including a plurality of plates arranged in abutting relationship between said overlapping edges, said plurality of plates including a first set of alternate plates configured to dispense adhesive to one of said opposed surfaces to form spaced lines of adhesive with gaps therebetween and a second set of alternate plates alternating with the plates of said first set configured to dispense adhesive to the other of said opposed surfaces to provide spaced lines of adhesive facing the gaps between spaced lines of adhesive on said one of said opposed surfaces;

(b) means for moving said overlapping edges past said applicator for applying adhesive to said opposed facing surfaces;

(c) said plates having exposed surfaces and abutting surfaces, each of said plates defining a cavity extending through abutting surface and communicating with a corresponding cavity in adjacent plates to form a continuous path therethrough; and (d) valve means for controlling flow of adhesive to said applicator;

(e) said apparatus including sealing jaws for forming a transverse seal and for moving said sheet material past said applicator when said sealing jaws are in their closed position, and means for simultaneously moving said sealing jaws to their closed position and opening said valve means for supplying adhesive to said applicator.

10. An applicator for supplying adhesive to overlapping edges of sheet material fed through a form, fill and seal type packaging machine for forming a continuous seal along said edges, said applicator comprising:

(a) a plurality of dispensing plates arranged in contiguous relationship;

(b) a first set of alternate plates having dispensing openings at one side of said applicator for dispensing adhesive in spaced lines along one of said edges;

(c) a second set of alternate plates alternating with the plates of said first set and having dispensing openings at the other side of said applicator for dispensing adhesive in spaced lines along the other of said edges;

(d) said first set of plates being displaced from said second set of plates so that adhesive dispensed from one set of plates provides spaced lines of adhesive forming gaps between spaced lines of adhesive provided from the other set of plates.

11. The applicator of claim 10 wherein said plates include aligned apertures forming a continuous cavity for receiving adhesive from a source of adhesive, and passages connecting said cavity to said dispensing openings.

12. The applicator of claim 10 wherein said plates include passages communicating with said dispensing openings for supplying adhesive to said openings and said passages are downwardly inclined in the direction of movement of the sheet material for facilitating the dispensing of said adhesive.

13. The method of applying adhesive to overlapping edges of package-forming sheet material to provide a seal therebetween comprising the steps of:

(a) providing an adhesive applicator having spaced adhesive dispensing openings on opposite sides thereof;

(b) moving said edges past the applicator;

(c) supplying adhesive to said applicator and to said openings for applying spaced lines of adhesive to said overlapping edges as they are moved past the applicator; and (d) moving said overlapping edges together with the lines of adhesive on one overlapping edge engaging the spaces between lines of adhesive on the other overlapping edge to provide a continuous adhesive coating.

14. The method of claim 13 wherein:

(a) said sheet material is moved downwardly during application of the adhesive; and (b) the adhesive is supplied to said openings through downwardly extending paths whereby movement of said sheet material past said openings assists flow of adhesive.

15. The method of claim 13 and further including the step of controlling the supply of adhesive to the applicator so that adhesive is dispensed only when the sheet material is being moved past the applicator.

* * * * *